US009975713B2

(12) United States Patent
Yamaguchi

(10) Patent No.: US 9,975,713 B2
(45) Date of Patent: May 22, 2018

(54) IMAGE FORMING APPARATUS INCLUDING OPTION DEVICE ATTACHABLE TO AND DETACHABLE FROM APPARATUS MAIN BODY

(71) Applicant: KYOCERA Document Solutions Inc., Osaka-shi, Osaka (JP)

(72) Inventor: Yoshihiro Yamaguchi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days. days.

(21) Appl. No.: 15/247,638

(22) Filed: Aug. 25, 2016

(65) Prior Publication Data

US 2017/0060077 A1 Mar. 2, 2017

(30) Foreign Application Priority Data

Aug. 28, 2015 (JP) ..... 2015-169668

(51) Int. Cl.
*B65H 1/28* (2006.01)
*B65H 1/26* (2006.01)
*G03G 21/16* (2006.01)

(52) U.S. Cl.
CPC ..... *B65H 1/28* (2013.01); *B65H 1/266* (2013.01); *G03G 21/16* (2013.01); *G03G 21/1647* (2013.01); *B65H 2402/62* (2013.01); *B65H 2801/06* (2013.01); *G03G 2221/1696* (2013.01)

(58) Field of Classification Search
CPC ..... B65H 1/28
USPC ..... 399/90
See application file for complete search history.

(56) References Cited

U.S. PATENT DOCUMENTS

2011/0243577 A1 10/2011 Marumoto

FOREIGN PATENT DOCUMENTS

| | | | |
|---|---|---|---|
| JP | 2000003122 | A | 1/2000 |
| JP | 2005210049 | A | 8/2005 |
| JP | 2011215261 | A | 10/2011 |

OTHER PUBLICATIONS

Computer translation of applicant's cited reference JP2000-003122A to Nakagaki; Jan. 2000.*

* cited by examiner

*Primary Examiner* — Quana M Grainger
(74) *Attorney, Agent, or Firm* — Alleman Hall Creasman & Tuttle LLP

(57) ABSTRACT

An image forming apparatus includes an option device, the option device is coupled with a lower surface of an apparatus main body. A second connector is configured to be displaced between a first position and a second position. A push portion is configured to be pressed toward an inside of the option device when the option device is coupled with the lower surface. A link portion is pivotably supported, coupled with both the push portion and the second connector, and configured to, interlocking with the push portion being pressed, cause the second connector to be displaced from second position to first position. A first coupling portion couples the push portion with the link portion. A second coupling portion is configured to couple the second connector with the link portion. The first coupling portion and/or the second coupling portion is configured to release the coupling with the link portion.

18 Claims, 9 Drawing Sheets

IMAGE FORMING APPARATUS INCLUDING OPTION DEVICE ATTACHABLE TO AND DETACHABLE FROM APPARATUS MAIN BODY

INCORPORATION BY REFERENCE

This application is based upon and claims the benefit of priority from the corresponding Japanese Patent Application No. 2015-169668 filed on Aug. 28, 2015, the entire contents of which are incorporated herein by reference.

BACKGROUND

The present disclosure relates to an image forming apparatus including an option device that can be attached to and detached from an apparatus main body of the image forming apparatus.

An image forming apparatus such as a copier or a printer includes a paper sheet feed cassette. The paper sheet feed cassette is integrally provided with a lower part of the image forming apparatus, and a lower surface of the sheet feed cassette constitutes a bottom surface of the image forming apparatus. Conventionally, the image forming apparatus is configured such that another paper sheet feed cassette can be attached, as an option device, to the bottom surface of the apparatus main body of the image forming apparatus.

The option cassette is configured to feed a print paper toward an image formation position when a print instruction is input to the image forming apparatus. The option cassette includes a motor for rotating a paper sheet feed roller, and a control portion for controlling the motor. When the option cassette is attached to the bottom surface of the apparatus main body, it is necessary to supply power or signals to the motor and the control portion. As a result, the option cassette and the apparatus main body respectively include connectors that are coupled with each other when the option cassette is attached to the image forming apparatus.

Conventionally, when a connector is broken, the maintenance work is performed in which the option cassette is separated from the apparatus main body by lifting the apparatus main body, and the connector is replaced. On the other hand, there is known, as a conventional technique, a connector connection structure where connectors can be attached and detached in the state where the option cassette is attached to the apparatus main body.

SUMMARY

An image forming apparatus according to an aspect of the present disclosure includes an option device, a first connector, a second connector, a push portion, a support frame, a link portion, a first coupling portion, and a second coupling portion. The option device is coupled with a lower surface of an apparatus main body of the image forming apparatus in an attachable/detachable manner. The first connector is disposed on the lower surface of the apparatus main body. The second connector is disposed on an upper surface of the option device and configured to be displaced between a first position and a second position, the second connector at the first position being connected to the first connector, the second connector at the second position retracting downward with respect to the first connector and not being connected to the first connector. The push portion is disposed adjacent to the second connector and configured to be pressed toward an inside of the option device when the option device is coupled with the lower surface of the apparatus main body. The support frame is disposed in the option device and configured to support the second connector and the push portion. The link portion is pivotably supported by the support frame, coupled with both the push portion and the second connector, and configured to, interlocking with the push portion being pressed, cause the second connector to be displaced from the second position to the first position. The first coupling portion is configured to couple the push portion with the link portion. The second coupling portion is configured to couple the second connector with the link portion. At least one of the first coupling portion and the second coupling portion is configured to release the coupling with the link portion.

An option device according to another aspect of the present disclosure is coupled with a lower surface of an apparatus main body of an image forming apparatus in an attachable/detachable manner. The option device includes a second connector, a push portion, a support frame, a link portion, a first coupling portion, and a second coupling portion. The second connector is disposed on an upper surface of the option device and configured to be displaced between a first position and a second position, the second connector at the first position being connected to a first connector which is disposed on the lower surface of the apparatus main body, the second connector at the second position retracting downward with respect to the first connector and not being connected to the first connector. The push portion is disposed adjacent to the second connector and configured to be pressed toward an inside of the option device when the option device is coupled with the lower surface of the apparatus main body. The support frame is configured to support the second connector and the push portion. The link portion is pivotably supported by the support frame, coupled with both the push portion and the second connector, and configured to, interlocking with the push portion being pressed, cause the second connector to be displaced from the second position to the first position. The first coupling portion is configured to couple the push portion with the link portion. The second coupling portion is configured to couple the second connector with the link portion. At least one of the first coupling portion and the second coupling portion is configured to release the coupling with the link portion.

A sheet feed device according to a further aspect of the present disclosure is coupled with a lower surface of an apparatus main body of an image forming apparatus in an attachable/detachable manner, and configured to store sheet members and feed the sheet members to the apparatus main body. The sheet feed device includes a second connector, a push portion, a support frame, a link portion, a first coupling portion, and a second coupling portion. The second connector is disposed on an upper surface of the sheet feed device and configured to be displaced between a first position and a second position, the second connector at the first position being connected to a first connector which is disposed on the lower surface of the apparatus main body, the second connector at the second position retracting downward with respect to the first connector and not being connected to the first connector. The push portion is disposed adjacent to the second connector and configured to be pressed toward an inside of the sheet feed device when the sheet feed device is coupled with the lower surface of the apparatus main body. The support frame is configured to support the second connector and the push portion. The link portion is pivotably supported by the support frame, coupled with both the push portion and the second connector, and configured to, interlocking with the push portion being pressed, cause the second connector to be displaced from the second position to the first position. The first coupling portion is configured to couple the push portion with the link portion. The second coupling portion is configured to couple the second connector with the link portion. At least one of the first coupling portion and the second coupling portion is configured to release the coupling with the link portion.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
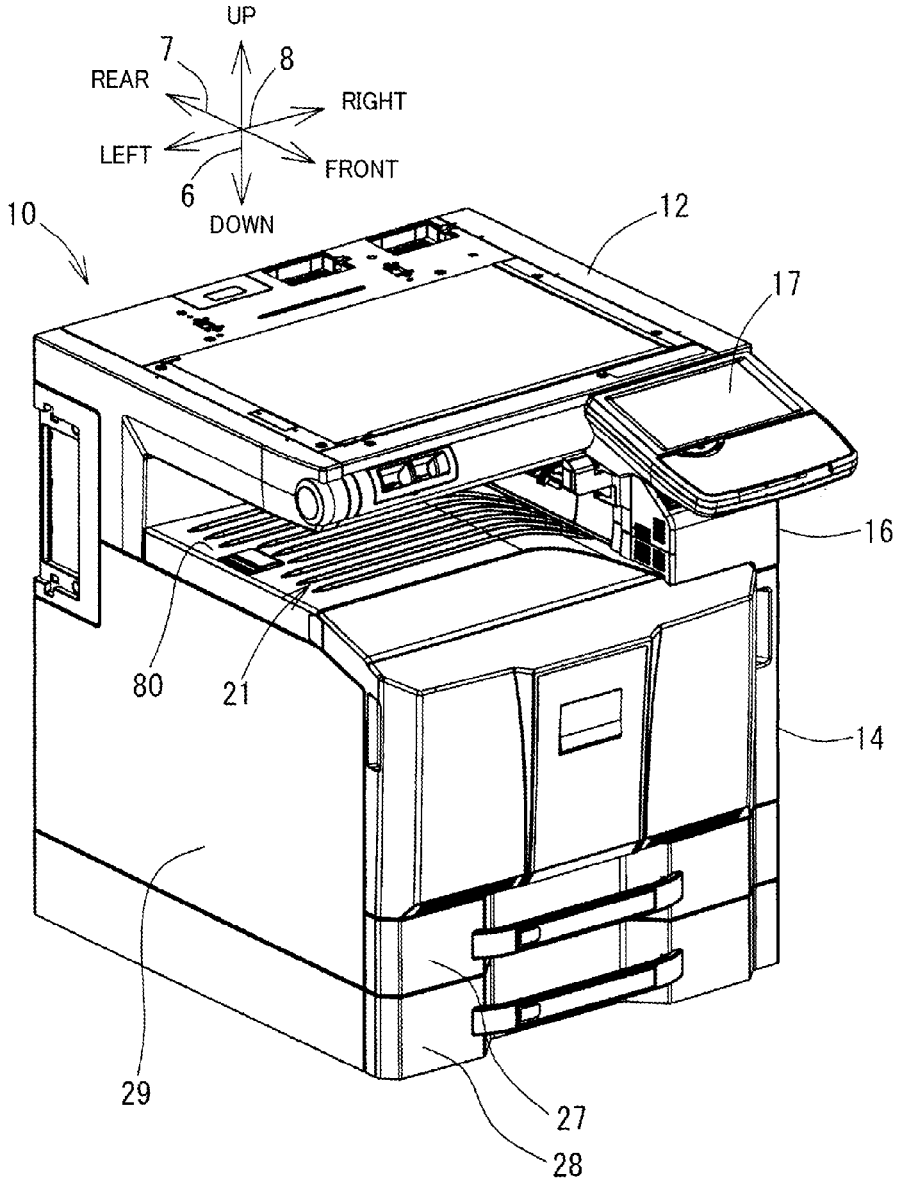
FIG. 1 is a perspective view of an image forming apparatus according to an embodiment of the present disclosure.

The following describes, with reference to the drawings, an image forming apparatus 10 according to an embodiment of the present disclosure. It is noted that, for the sake of explanation, a vertical direction in a state where the image forming apparatus 10 is installed on a flat surface (the state shown in FIG. 1) is defined as an up-down direction 6. In addition, a front-rear direction 7 is defined on a supposition that a side on which an operation/display panel 17 is provided is a front side. Furthermore, a left-right direction 8 is defined based on the front side of the image forming apparatus 10. It should be noted that the following embodiment is an example of a specific embodiment of the present disclosure and should not limit the technical scope of the present disclosure.

First, an outlined configuration of the image forming apparatus 10 is described with reference to FIG. 1 to FIG. 3.

As shown in FIG. 1, the image forming apparatus 10 is a multifunction peripheral of a so-called in-body discharge type, and has a plurality of functions such as the functions of a printer, a copier, a facsimile apparatus, and a scanner. The image forming apparatus 10 forms an image, based on input image data, on a print sheet (an example of the sheet member of the present disclosure) by using a print material such as toner. It is noted that the image forming apparatus 10 is not limited to a multifunction peripheral, but may be a dedicated apparatus such as a printer, a copier, or a facsimile apparatus, and the present disclosure is applicable thereto.

The image forming apparatus 10 includes an image reading portion 12 and an image forming portion 14. The image reading portion 12 performs a process of reading an image from a document sheet, and is provided in the upper portion of the image forming apparatus 10. It is noted that in FIG. 1, a document sheet cover of the image reading portion 12 is omitted. The image forming portion 14 performs a process of forming an image based on the electrophotography, and is provided below the image reading portion 12. The image forming portion 14 includes two paper sheet feed devices 27 and 28 that are arranged as two tiers in the vertical direction. In addition, in the right side of the image forming portion 14, a paper sheet discharge portion 16 is provided. It is noted that the image forming portion 14 is not limited to the an electrophotographic image forming portion, but may be an image forming portion adapted to an inkjet recording method or other recording or printing methods.

The image forming portion 14 includes a housing 29 (an example of the apparatus main body of the present disclosure). The paper sheet feed device 27, the upper one of the two paper sheet feed devices, is integrally provided with a lower part of the housing 29. The paper sheet feed device 28 (an example of the option device and the sheet feed device of the present disclosure), the lower one of the two paper sheet feed devices, is an extension type and is attached to the bottom surface of the housing 29 as an option device. The paper sheet feed device 28 is configured to be attachable to and detachable from the bottom surface of the housing 29.

Above the image forming portion 14, a sheet discharge space 21, into which print sheets are discharged, is provided. The paper sheet discharge portion 16 is provided such that it couples the image forming portion 14 with the image reading portion 12, while forming the sheet discharge space 21 between the image forming portion 14 and the image reading portion 12. As shown in FIG. 1, the front side and the left side of the sheet discharge space 21 are opened. In addition, the rear side and the right side of the sheet discharge space 21 are not opened. The rear side is closed, and on the right side thereof, the paper sheet discharge portion 16 is provided. A sheet discharge tray 80 for holding discharged print sheets is provided in the sheet discharge space 21.

Furthermore, the image forming portion 14 includes a conveyance mechanism, a transfer device, a fixing device, and a control portion that controls these components (all of these are not shown).

When a print instruction is input to the image forming apparatus 10 together with image data that is the target of the printing, a print sheet of a predetermined size is fed from either of the paper sheet feed devices 27 and 28. The fed print sheet is conveyed to the transfer device, and a toner image corresponding to the image data is formed on the print sheet. Thereafter, the toner image is fixed to the print sheet by the fixing device. The print sheet with the image printed thereon is discharged by the paper sheet discharge portion 16 onto the sheet discharge tray 80 in the sheet discharge space 21.

[Paper Sheet Feed Device 28]

The paper sheet feed device 28 is attached to a lower part of the image forming apparatus 10 in a detachable manner, and is used in a state of being coupled with a bottom surface 23 of the image forming portion 14. FIG. 1 shows the state where the paper sheet feed device 28 is coupled with the bottom surface 23 (see FIG. 4) of the image forming portion 14. FIG. 2 and FIG. 3 each show a single paper sheet feed device 28. As shown in FIG. 2 and FIG. 3, the paper sheet feed device 28 includes a housing 30 that is coupled with the bottom surface 23 of the image forming portion 14. A paper sheet feed tray 31 is attached to the housing 30. The paper sheet feed tray 31 is attached to the housing 30 in such a manner that the paper sheet feed tray 31 can be inserted from the front side of the housing 30 and drawn out in the front-rear direction 7. Print sheets are stacked in the paper sheet feed tray 31.

A conveyance path is formed inside the image forming portion 14, wherein the conveyance path extends from an inlet (not shown) formed in the bottom surface 23 (see FIG. 4) of the image forming portion 14, passes through the paper sheet feed device 27, and goes upward in the vertical direction. In addition, a conveyance path 39 extending in the vertical direction is formed inside the paper sheet feed device 28. A side cover 42 is attached to a side surface of the paper sheet feed device 28 (in the present embodiment, the right side surface when viewed from the front side), and an inner side surface of the side cover 42 constitutes an outer guide surface of the conveyance path 39.

An upper end of the conveyance path 39 reaches an upper surface of the paper sheet feed device 28. In other words, the upper end of the conveyance path 39 reaches a coupled surface 36 that is coupled with the bottom surface 23 of the image forming portion 14. The conveyance path 39 is opened upward through an opening 37 formed in the coupled surface 36. That is, an upper end of the conveyance path 39 is the opening 37. In the present embodiment, a positioning is performed such that the opening 37 of the coupled surface 36 and the inlet of the bottom surface 23 face each other in the state where the paper sheet feed device 28 is attached to the bottom surface 23 (see FIG. 4) of the image forming portion 14. A conveyance roller is provided in the conveyance path 39. A print sheet fed from the paper sheet feed tray 31 is conveyed by the conveyance roller to the conveyance path of the image forming portion 14 by passing through the conveyance path 39.

Figure 2:
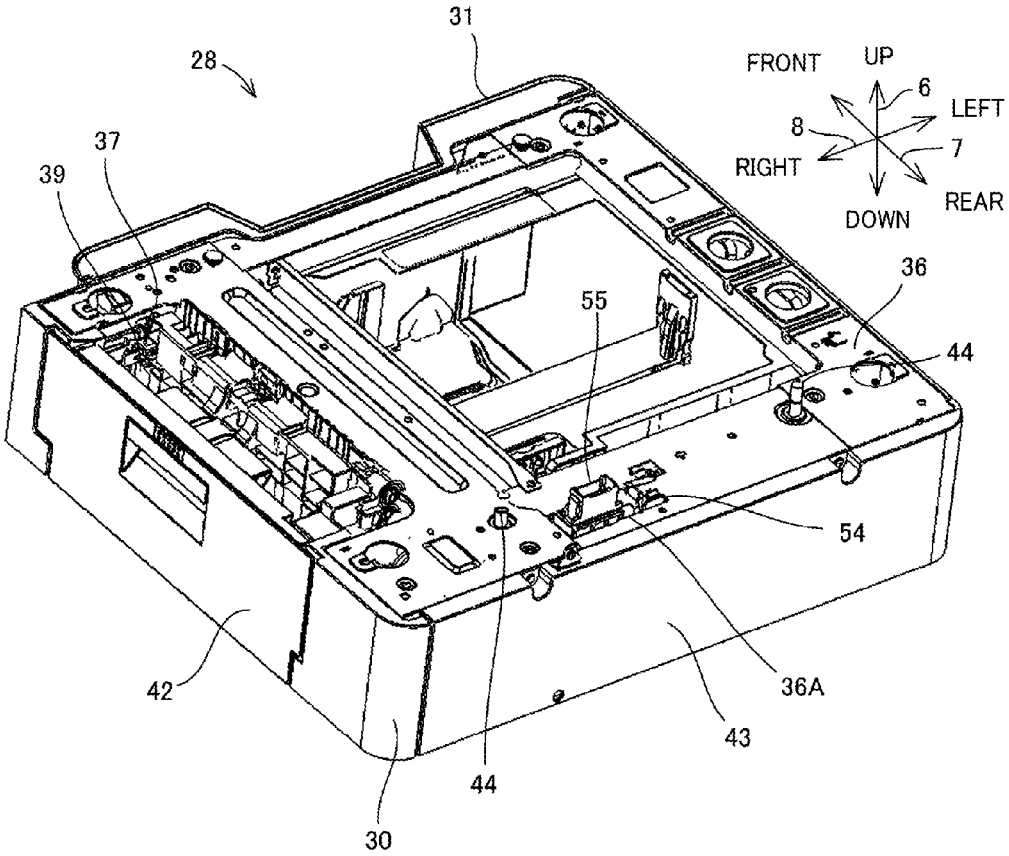
FIG. 2 is a perspective view of a paper sheet feed device attached to the image forming apparatus.

As shown in FIG. 2, two projections 44 are formed on the coupled surface 36 of the paper sheet feed device 28. The projections 44 project upward from the coupled surface 36. The projections 44 are used for a positioning such that the image forming portion 14 and the paper sheet feed device 28 are attached to predetermined coupling positions when the image forming portion 14 is coupled with the coupled surface 36. Although not shown in the drawings, two insertion holes are formed in the bottom surface 23 of the image forming portion 14, and the projections 44 are inserted in the insertion holes. In the present embodiment, the two projections 44 are disposed in the rear of the paper sheet feed device 28.

[Connection Mechanism 50]

Figure 3:
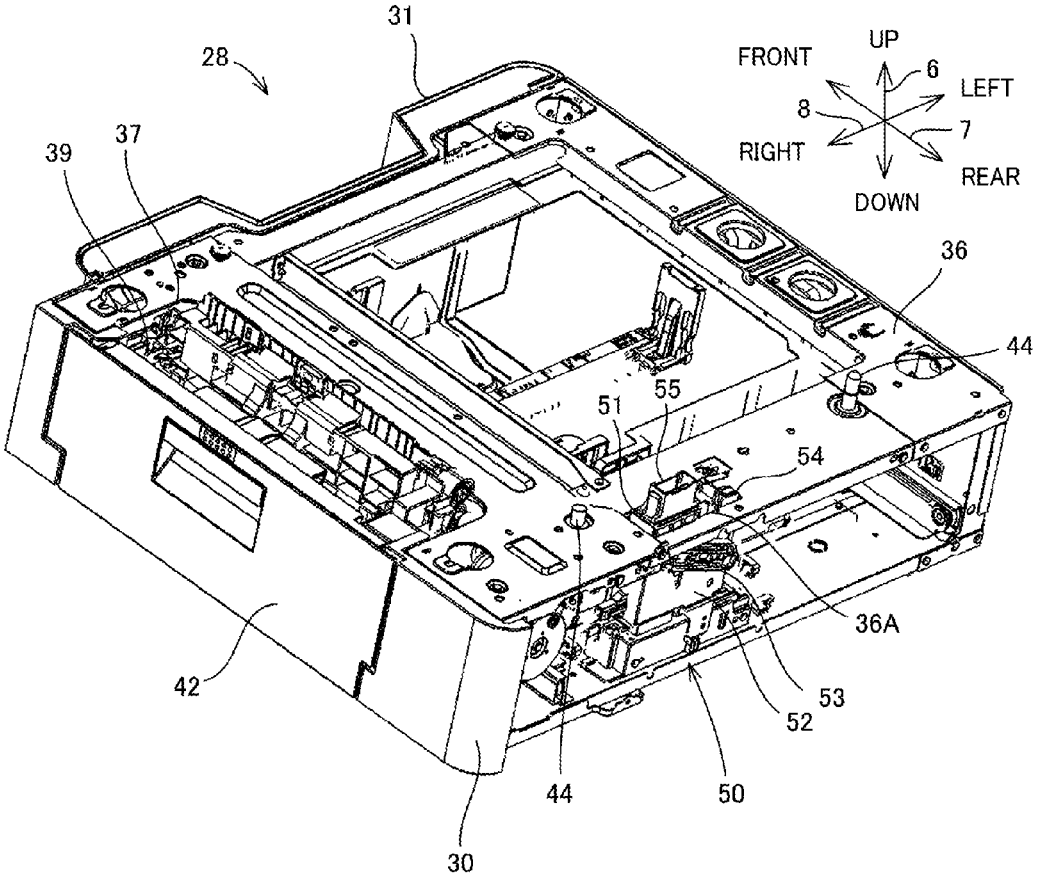
FIG. 3 is a perspective view of the paper sheet feed device attached to the image forming apparatus.
Figure 4:
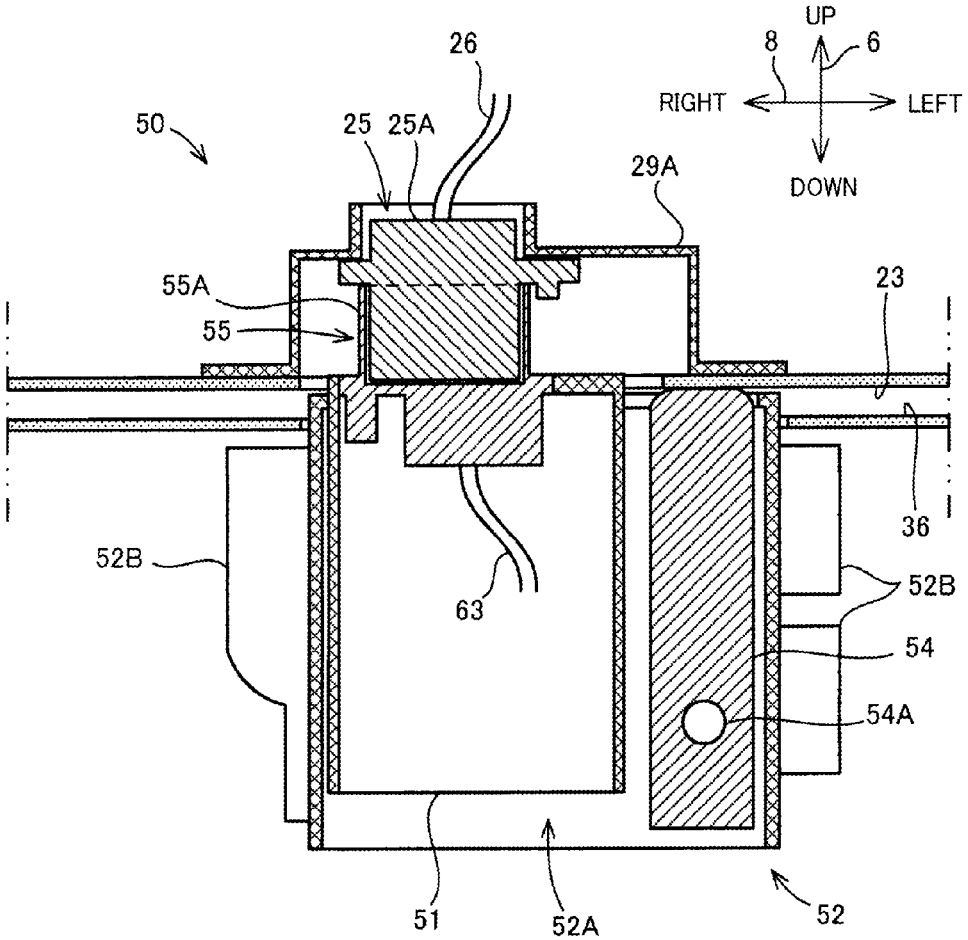
FIG. 4 is a schematic cross section showing a connector connection state in a state where the paper sheet feed device is attached to the image forming apparatus.

As shown in FIG. 3, the paper sheet feed device 28 includes a connector connection mechanism 50 (hereinafter simply referred to as a connection mechanism 50). The connection mechanism 50, when the image forming portion 14 is coupled with the paper sheet feed device 28, electrically connects the bottom surface 23 (see FIG. 4) of the image forming portion 14 to the coupled surface 36 of the paper sheet feed device 28. Specifically, a connector 25 (an example of the first connector of the present disclosure) is provided on the bottom surface 23 of the image forming portion 14, and a connector 55 (an example of the second connector of the present disclosure) is provided on the coupled surface 36 of the paper sheet feed device 28. The connection mechanism 50 connects the connector 25 to the connector 55 when the image forming portion 14 is coupled with the paper sheet feed device 28. The connector 25 and the connector 55 are so-called drawer connectors. It is noted that FIG. 4 is a schematic cross section showing a connection state between the connector 25 of the image forming portion 14 and the connector 55 of the paper sheet feed device 28.

The connector 25 is attached to a support member 29A that is fixed to the housing 29. The connector 25 is electrically connected to one end of a cable 26 that includes a plurality of electric wires including a signal line and a power line. The other end of the cable 26 is electrically connected to the control portion of the image forming portion 14. The connector 25 includes a housing 25A of a parallelepiped rectangular shape. A lower surface of the housing 25A includes a plurality of contact terminals into which a plurality of connector pins of the connector 55 are inserted and contacted.

Figure 5:
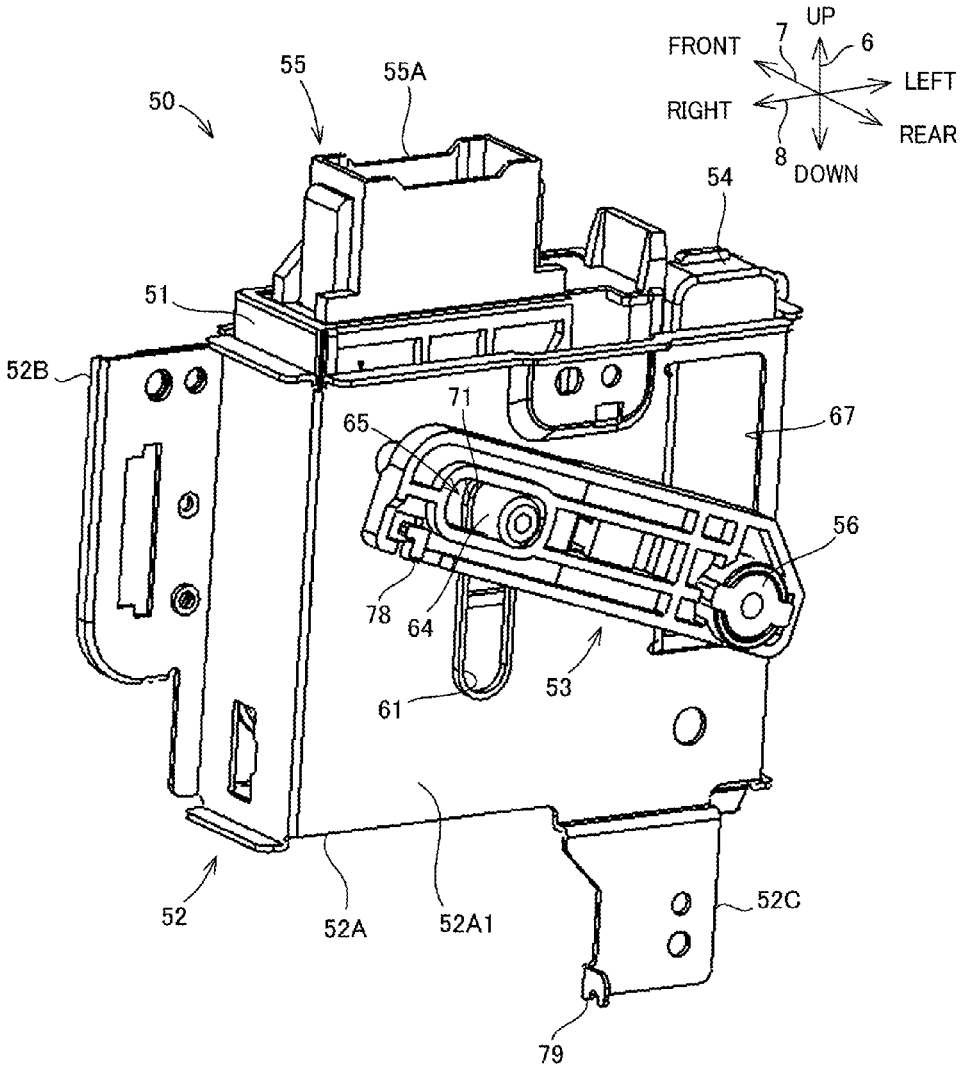
FIG. 5 is a perspective view of a connector connection mechanism provided in a paper sheet feed device.
Figure 6:
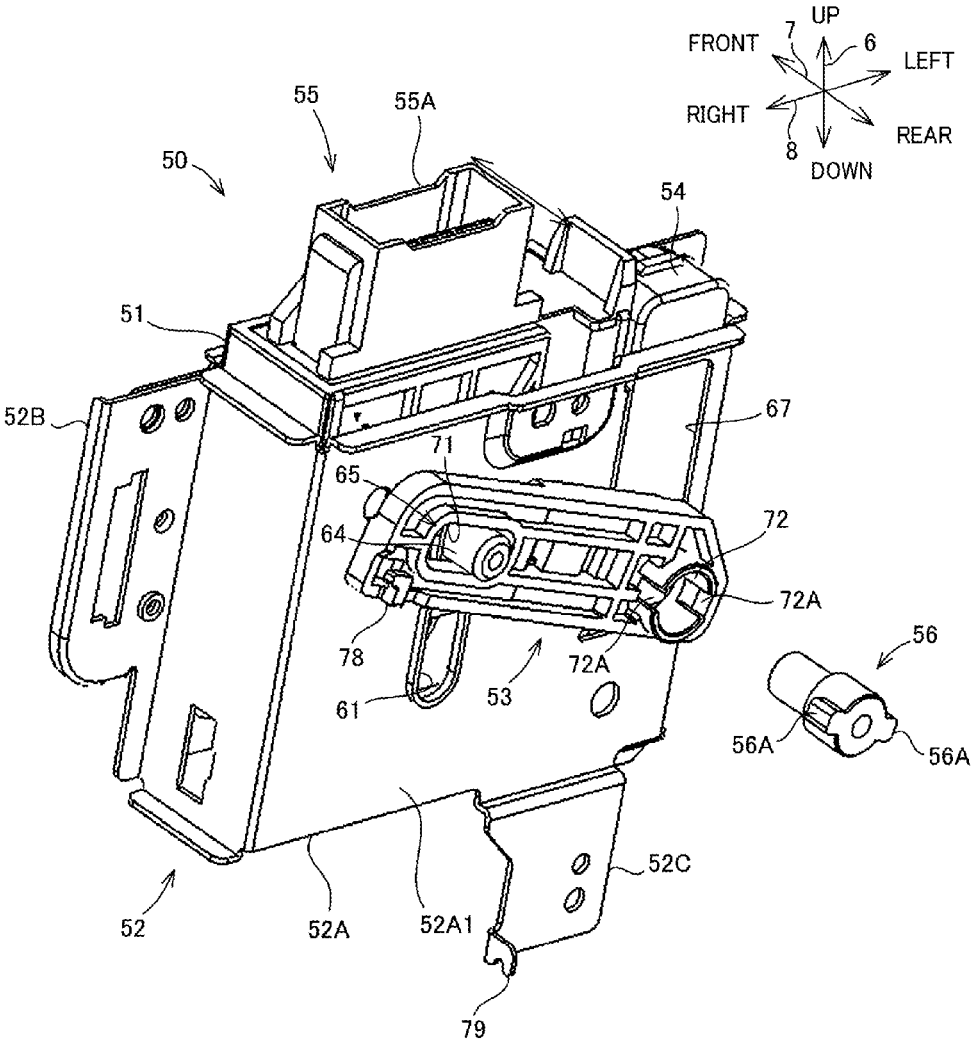
FIG. 6 is a perspective view showing a state where an engagement pin has been removed from the connector connection mechanism provided in the paper sheet feed device.

FIG. 5 and FIG. 6 are perspective diagrams showing the connection mechanism 50. As shown in FIG. 5 and FIG. 6, the connection mechanism 50 includes a holder 51, a frame 52 (an example of the support frame of the present disclosure), a link arm 53 (an example of the link portion of the present disclosure), a push rod 54 (an example of the push portion of the present disclosure), the connector 55, and a coil spring 57 (see FIG. 7, an example of the biasing member of the present disclosure).

The frame 52 is provided in the housing 30 of the paper sheet feed device 28. The frame 52 is formed by, for example, bending a metal plate. The frame 52 includes a storage portion 52A and a bracket 52B, wherein the storage portion 52A stores the holder 51 such that the holder 51 can move in the up-down direction 6, and the bracket 52B is fixed to the housing 30. The holder 51 is stored in the storage portion 52A. The bracket 52B is fixed with screws or the like to an intermediate plate (not shown) in the housing 30.

The holder 51 is stored in the storage portion 52A. The holder 51 is supported by the frame 52 so as to be movable in the storage portion 52A in the up-down direction 6. In the present embodiment, the holder 51 is supported such that the connector 55 provided in the holder 51 can move between a first position (the position shown in FIG. 5) and a second position (the position shown in FIG. 7). In other words, the frame 52 supports the connector 55 so that the connector 55 can be displaced between the first position and the second position. Here, the first position is the position shown in FIG. 4 and FIG. 5, and is a connection position at which the connector 55 is connected to the connector 25. When the connector 55 is at the first position, the connector 55 projects upward from an opening 36A (see FIG. 2) which is formed in the coupled surface 36 of the housing 30. In addition, the second position is the position shown in FIG. 7, and is set to be lower than the first position. The second position is a non-connection position at which the connector 55 retracts downward with respect to the connector 25 and is not connected to the connector 25 in the state where the image forming portion 14 is coupled with the paper sheet feed device 28. When the connector 55 is at the second position, the connector 55 is buried under the opening 36A.

The connector 55 is fixed to an upper surface of the holder 51. The connector 55 is electrically connected to one end of a cable 63 that includes a plurality of electric wires including a signal line and a power line. The other end of the cable 63 is electrically connected to a control board mounted on the paper sheet feed device 28. The connector 55 includes a housing 55A of a parallelepiped rectangular shape. An upper surface of the housing 55A is concave, and a plurality of connector pins are provided in the concave surface of the housing 55A. When the connector 55 is connected to the connector 25, the connector pins are inserted in and electrically contact the contact terminals of the connector 25. As described above, the connector 55 is fixed to the holder 51. As a result, when the holder 51 moves in the up-down direction 6, the connector 55 moves, too. Accompanying the movement of the holder 51, the connector 55 is displaced between the first position and the second position.

A guide hole 61 is formed in an outer wall 52A1 of the storage portion 52A. The guide hole 61 is elongated in the up-down direction 6. A guide pin 64 is provided on a side surface of the holder 51. The guide pin 64 projects from the side surface of the holder 51 in a direction perpendicular to the side surface. In the state where the holder 51 is stored in the storage portion 52A, the guide pin 64 is inserted in the guide hole 61. This state of the guide pin 64 inserted in the guide hole 61 allows the holder 51 to be guided to move in the storage portion 52A in the up-down direction 6 without rattle.

In the storage portion 52A, the push rod 54 and the holder 51 are stored side by side. That is, the push rod 54 is provided in the frame 52 together with the holder 51. The push rod 54 is supported so as to be displaceable between a projected position (the position shown in FIG. 7) and a buried position (see FIG. 4 and FIG. 5) in the storage portion 52A. At the projected position, the push rod 54 projects upward from the opening 36A of the coupled surface 36. At the buried position, the push rod 54 is buried in the storage portion 52A of the frame 52. That is, the frame supports the push rod 54 such that the push rod 54 can be displaced in the up-down direction 6 between the projected position and the buried position.

Figure 7:
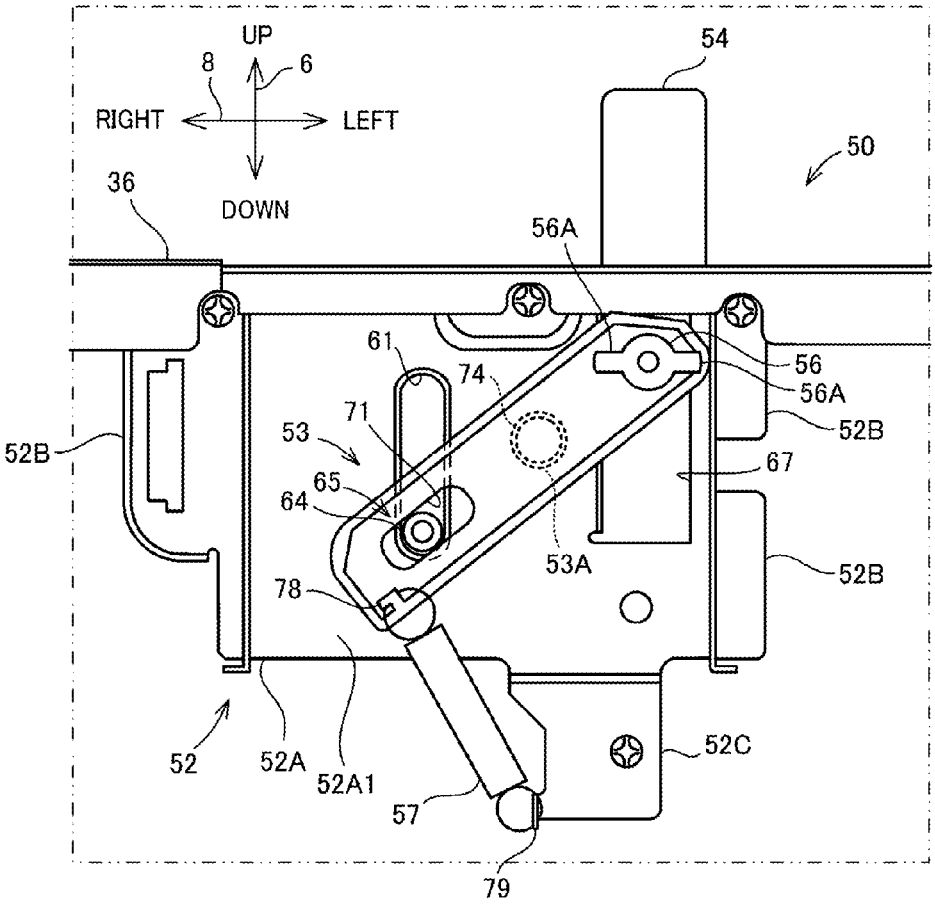
FIG. 7 is a diagram showing an operation state of the connector connection mechanism, and shows a non-coupled state where an image forming portion is not coupled with the paper sheet feed device.

In a non-coupled state (see FIG. 7) where the image forming portion 14 is not coupled with the paper sheet feed device 28, the push rod 54 maintains the projected position (the attitude shown in FIG. 7). In the present embodiment, the link arm 53 and the like cause the push rod 54 to maintain the projected position, wherein the link arm 53 is described below. The push rod 54 maintains the projected position in the non-coupled state, and during a process in which the image forming portion 14 is coupled with the paper sheet feed device 28, the bottom surface 23 of the image forming portion 14 presses the top of the push rod 54 downward. That is, the push rod 54 is pressed by the image forming portion 14 toward the inside of the housing 30. Subsequently, when the image forming portion 14 is coupled with the paper sheet feed device 28 and their state changes from the non-coupled state to a coupled state (see FIG. 8), the push rod 54 is displaced to the buried position (see FIG. 4 and FIG. 5) where the push rod 54 is buried in the storage portion 52A of the frame 52.

An opening 67 is formed in the outer wall 52A1 of the storage portion 52A. The opening 67 is formed at a position more on the left side (the right side in the plane of FIG. 9) than the guide hole 61. That is, the opening 67 and the guide hole 61 are formed at positions separated in the left-right direction 8. The opening 67 is formed at a position corresponding to the push rod 54. As a result, as shown in FIG. 5, a part of a side of the push rod 54 is exposed through the opening 67.

In a lower part of the side of the push rod 54, an engagement hole 54A (see FIG. 4, an example of the engagement hole of the present disclosure) is formed. In the engagement hole 54A, a coupling pin 56 (an example of the first coupling portion of the present disclosure) described below is inserted and engaged.

The link arm 53 is attached to the outer wall 52A1 of the frame 52. The link arm 53 is coupled with both the push rod 54 and the holder 51, and during the process in which the image forming portion 14 is coupled with the paper sheet feed device 28, the link arm 53, interlocking with the push rod 54 being pressed, causes the connector 55, together with the holder 51, to be displaced from the second position to the first position. The connection mechanism 50 of the present embodiment further includes the coupling pin 56 and an engagement mechanism 65 (an example of the second coupling portion of the present disclosure). The link arm 53 is coupled with the push rod 54 by the coupling pin 56, and is coupled with the holder 51 by the engagement mechanism 65.

The link arm 53 is a narrow-width, plate-like member. The link arm 53 is pivotably supported by the outer wall 52A1. Specifically, as shown in FIG. 7, a shaft 74 is provided on the outer wall 52A1. The shaft 74 is provided between the guide hole 61 and the opening 67 of the outer wall 52A1. The shaft 74 is erected vertically from the outer wall 52A1 outward. The link arm 53 is pivotably supported by the shaft 74. On a rear side (the outer wall 52A1 side) of the link arm 53, a shaft hole 53A is formed, and the shaft 74 is inserted in the shaft hole 53A. It is noted that the shaft hole 53A is formed in the proximity of the center of the link arm 53 in its longitudinal direction. In addition, although not shown in the drawings, a stopper pin or the like is provided to prevent the link arm 53 from slipping off the shaft hole 53A.

One end of the link arm 53 is coupled with the holder 51 by the engagement mechanism 65. In other words, one end of the link arm 53 is coupled with the connector 55 via the holder 51. In the link arm 53, a long hole 71 is formed in an end portion closer to the guide hole 61 than to the shaft hole 53A, the long hole 71 being elongated in the longitudinal direction of the link arm 53. The long hole 71 and the above-described guide pin 64 (an example of the pin member of the present disclosure) constitute the engagement mechanism 65. Specifically, the guide pin 64 is inserted in the long hole 71 such that one end of the link arm 53 is coupled with the connector 55 via the holder 51 by the engagement mechanism 65.

The other end of the link arm 53 is coupled with the push rod 54 by the coupling pin 56. In the link arm 53, a through hole 72 is formed in an end portion closer to the opening 67 than to the shaft hole 53A. As shown in FIG. 5, in the state where the through hole 72 and the engagement hole 54A are aligned with each other, the coupling pin 56 is inserted through the through hole 72 and further inserted in the engagement hole 54A. As such, the other end of the link arm 53 is coupled with the push rod 54 by the coupling pin 56.

Figure 8:
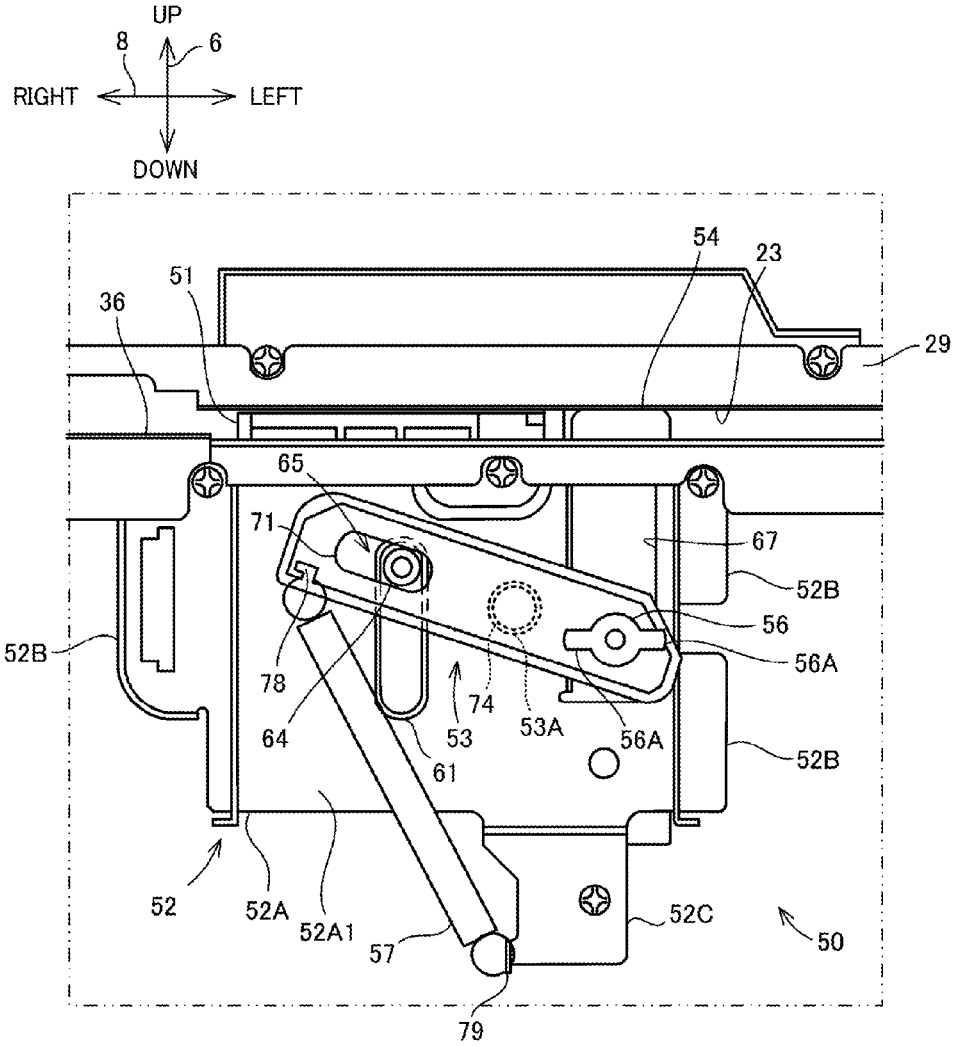
FIG. 8 is a diagram showing an operation state of the connector connection mechanism, and shows a coupled state where the image forming portion is coupled with the paper sheet feed device.

In the present embodiment, as shown in FIG. 7, in the non-coupled state where the push rod 54 is at the projected position, the holder 51 is displaced to the second position by the link arm 53. In this state, the connector 55 is not connected to the connector 25. In addition, as shown in FIG. 8, in the coupled state where the push rod 54 is pressed downward and displaced to the buried position, the link arm 53, interlocking with the downward displacement of the push rod 54, causes the holder 51 to be displaced from the second position to the first position. Here, together with the displacement of the holder 51, the connector 55 is displaced upward and moved to the connection position. During this movement, the connector 55 is connected to the connector 25. When the connector 55 reaches the connection position, the connector 55 and the connector 25 are securely connected to each other.

Conversely, when the state changes from the coupled state to the non-coupled state where the image forming portion 14 is not coupled with the paper sheet feed device 28, the push rod 54 moves upward and is displaced from the buried position to the projected position.

In the non-coupled state (see FIG. 8), the upward movement of the push rod 54 is realized by the biasing force of the coil spring 57. As shown in FIG. 7, one end of the coil spring 57 is coupled with the frame 52. Specifically, one end of the coil spring 57 is attached to a tip portion 79 of an extension piece 52C which extends downward from a lower end of the outer wall 52A1 of the frame 52. The other end of the coil spring 57 is coupled with the connector 55 via one end of the link arm 53. Specifically, the other end of the coil spring 57 is attached to an engaging portion 78 provided at one end of the link arm 53. As a result, the other end of the coil spring 57 is coupled with the connector 55 via the engaging portion 78, the long hole 71 of the link arm 53, the guide pin 64, and the holder 51. The coil spring 57 is a so-called pulling spring that always generates a pulling force. Since the coil spring 57 is provided, when the state changes from the coupled state to the non-coupled state, the holder 51 and the connector 55 receive the biasing force of the coil spring 57 and move downward (toward the second position) and the push rod 54 moves upward (toward the projected position). That is, the coil spring 57 biases the connector 55 toward the second position, and, at the same time, biases the push rod 54 toward the first position via the link arm 53.

The coupling pin 56 couples the link arm 53 with the push rod 54 in such a manner that the coupling between the link arm 53 and the push rod 54 can be released. Specifically, the coupling pin 56 is a pin member that is inserted through the through hole 72 of the link arm 53 and is engaged with the engagement hole 54A of the push rod 54. As a result, the coupling pin 56 can be easily inserted in and removed from the through hole 72 and the engagement hole 54A (see FIG. 6).

In the present embodiment, as shown in FIG. 6, the coupling pin 56 includes a pair of protruding pieces 56A protruding from the coupling pin 56 in a direction perpendicular to an axis of the coupling pin 56. In addition, the link arm 53 includes a pair of grooves 72A formed on a peripheral edge of the through hole 72. The grooves 72A are each formed in a cut shape that extends from the peripheral edge of the through hole 72 in an insertion direction of the coupling pin 56 with respect to the through hole 72. When the coupling pin 56 is inserted through the through hole 72 and reaches a position where the link arm 53 is coupled with the push rod 54, the protruding pieces 56A enter the grooves 72A. This prevents the coupling pin 56 from rotating in the circumferential direction. That is, the protruding pieces 56A and the grooves 72A function as a rotation stopper of the coupling pin 56.

Figure 9:
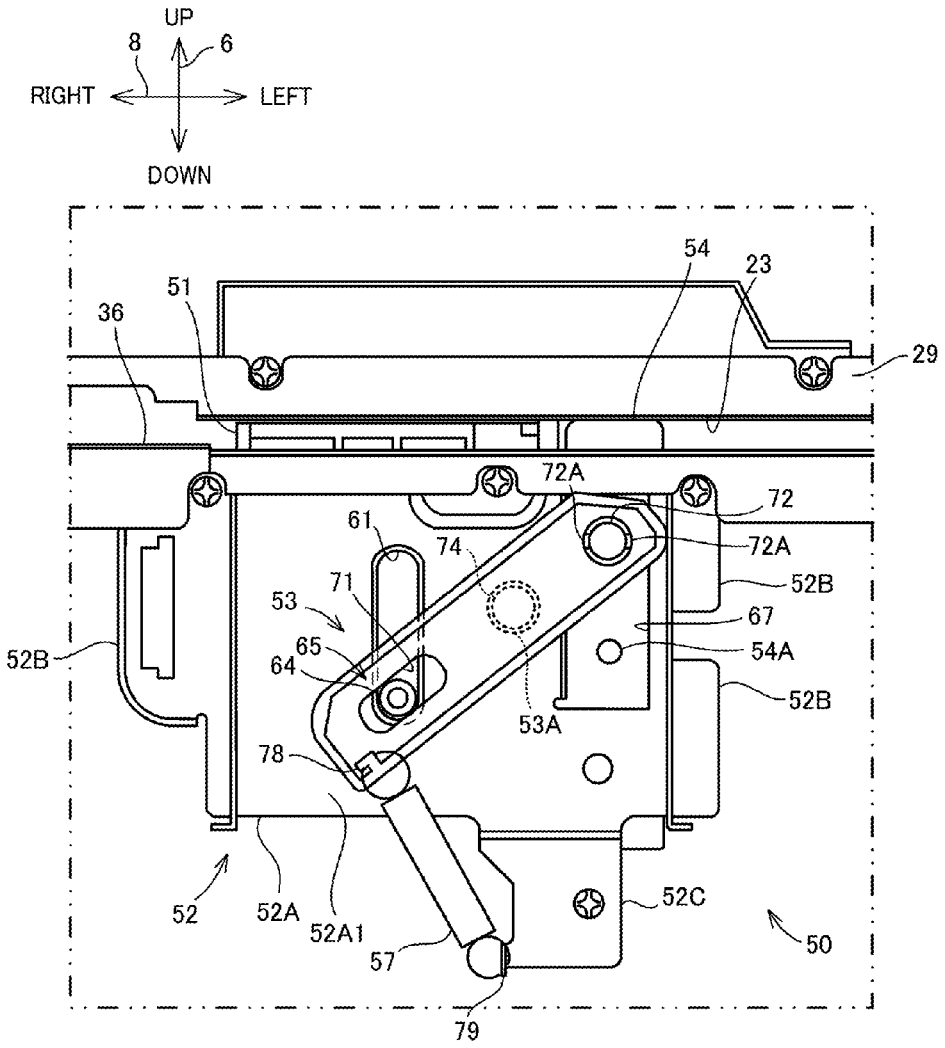
FIG. 9 is a diagram showing an operation state of the connector connection mechanism, and shows a state where a coupling pin has been removed in the coupled state where the image forming portion is coupled with the paper sheet feed device.

Since the connection mechanism 50 having the above-described configuration is provided in the image forming apparatus 10, the connection between the connector 25 and the connector 55 can be easily released while in the coupled state (see FIG. 8). That is, according to a conventional connector connection configuration, a connection between connectors cannot be released in the coupled state unless fixing tools such as a plurality of screws are removed. The conventional connector connection configuration imposes a large operation load on connecting or disconnecting the connectors. In the image forming apparatus 10 of the present embodiment, with the connection mechanism 50 having the above-described configuration, even in the coupled state where the image forming portion 14 is coupled with the paper sheet feed device 28, the connection between the connector 25 and the connector 55 can be easily released by removing the coupling pin 56, as shown in FIG. 9. That is, the connection mechanism 50 makes it possible to easily connect or disconnect the connector 25 and the connector 55.

In the above-described embodiment, one end of the coil spring 57 is attached to the engaging portion 78. However, not limited to this, it may be attached to the guide pin 64 or the holder 51. Of course, it may be attached directly to the connector 55. In addition, in the above-described embodiment, the coil spring 57 is described as one example of the biasing member. However, not limited to this, any biasing member other than the coil spring 57 is applicable as far as it biases the connector 55 toward the second position and biases the push rod 54 toward the projected position via the link arm 53.

Furthermore, in the above-described embodiment, the link arm 53 is described as one example of the link portion. However, in place of the link arm 53, a configuration where a plurality of link levers are used to realize the same movement of the link arm 53 may be applied.

In addition, in the above-described embodiment, as one example of the coupling portion, the coupling pin 56 makes and releases the coupling between the link arm 53 and the push rod 54. However, the coupling portion of the present disclosure is not limited to this configuration. For example, the coupling between the link arm 53 and the push rod 54 may not be released, and, on the other hand, the link arm 53 may be coupled with the connector 55 and the coupling therebetween may be released by a coupling portion that has the same configuration as the coupling pin 56. In this case, the engagement mechanism 65 (the mechanism composed of the guide pin 64 and the long hole 71) that couples the link arm 53 with the holder 51 is applicable to the coupling between the link arm 53 and the push rod 54. Of course, the link arm 53 and the connector 55 may be directly coupled with each other by a coupling tool. Alternatively, the link arm 53 and the connector 55 may be indirectly coupled with each other via the holder 51.

In the above-described embodiment, the link arm 53 and the holder 51 are coupled with each other by the engagement mechanism 65. On the other hand, the engagement mechanism 65 may be configured to release the coupling between the link arm 53 and the holder 51. For example, in the above-described embodiment, the guide pin 64 is provided on a side surface of the holder 51. The guide pin 64 may be attached to a side surface of the holder 51 in a detachable manner. With regard to the detachable configuration, for example, the guide pin 64 may be attached to a side surface of the holder 51 by screws, or an engagement hole may be formed on a side surface of the holder 51, and the guide pin 64 may be engaged to and disengaged from the engagement hole. If the engagement mechanism 65 includes such a guide pin 64, it will be possible to release the coupling between the link arm 53 and the holder 51 by removing the guide pin 64 from the holder 51. In this case, since the coupling between the link arm 53 and the push rod 54 can also be released by the coupling pin 56, it becomes possible to release both the coupling between the link arm 53 and the push rod 54 and the coupling between the link arm 53 and the holder 51.

In the above-described embodiment, the paper sheet feed device 28 is described as an example of the option device. However, the option device is not limited to the paper sheet feed device 28. For example, the present disclosure is applicable to an image forming apparatus 10 in which a post-processing device, as an option device, is coupled with the image forming portion 14, wherein the post-processing device performs a stapling process, a punching process or the like on print sheets on which images have been formed.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An option device coupled with a lower surface of an apparatus main body of an image forming apparatus in an attachable/detachable manner, the option device comprising:

a second connector disposed on an upper surface of the option device and configured to be displaced between a first position and a second position, the second connector at the first position being connected to a first connector which is disposed on the lower surface of the apparatus main body, the second connector at the second position retracting downward with respect to the first connector and not being connected to the first connector;

a push portion disposed adjacent to the second connector and configured to be pressed toward an inside of the option device when the option device is coupled with the lower surface of the apparatus main body;

a support frame configured to support the second connector and the push portion;

a link portion pivotably supported by the support frame, coupled with both the push portion and the second connector, and configured to, interlocking with the push portion being pressed, cause the second connector to be displaced from the second position to the first position;

a biasing member configured to couple the support frame with the link portion, bias the second connector toward the second position via the link portion, and bias the push portion toward the apparatus main body;

a first coupling portion configured to couple the push portion with the link portion; and a second coupling portion configured to couple the second connector with the link portion, wherein at least one of the first coupling portion and the second coupling portion is configured to release the coupling with the link portion.

2. An option device coupled with a lower surface of an apparatus main body of an image forming apparatus in an attachable/detachable manner, the option device comprising:

a second connector disposed on an upper surface of the option device and configured to be displaced between a first position and a second position, the second connector at the first position being connected to a first connector which is disposed on the lower surface of the apparatus main body, the second connector at the second position retracting downward with respect to the first connector and not being connected to the first connector;

a push portion disposed adjacent to the second connector and configured to be pressed toward an inside of the option device when the option device is coupled with the lower surface of the apparatus main body;

a support frame configured to support the second connector and the push portion;

a link portion pivotably supported by the support frame, coupled with both the push portion and the second connector, and configured to, interlocking with the push portion being pressed, cause the second connector to be displaced from the second position to the first position;

a first coupling portion configured to couple the push portion with the link portion; and a second coupling portion configured to couple the second connector with the link portion, wherein the push portion is supported by the support frame so as to be displaceable between a projected position and a buried position, the push portion at the projected position projecting upward from the upper surface of the option device, the push portion at the buried position being buried downward in the inside of the option device from the upper surface of the option device, and at least one of the first coupling portion and the second coupling portion is configured to release the coupling with the link portion.

3. An option device coupled with a lower surface of an apparatus main body of an image forming apparatus in an attachable/detachable manner, the option device comprising:

a second connector disposed on an upper surface of the option device and configured to be displaced between a first position and a second position, the second connector at the first position being connected to a first connector which is disposed on the lower surface of the apparatus main body, the second connector at the second position retracting downward with respect to the first connector and not being connected to the first connector;

a push portion disposed adjacent to the second connector and configured to be pressed toward an inside of the option device when the option device is coupled with the lower surface of the apparatus main body;

a support frame configured to support the second connector and the push portion;

a link portion pivotably supported by the support frame, coupled with both the push portion and the second connector, and configured to, interlocking with the push portion being pressed, cause the second connector to be displaced from the second position to the first position;

a first coupling portion configured to couple the push portion with the link portion; and a second coupling portion configured to couple the second connector with the link portion, wherein the support frame includes a holder holding the second connector, the holder being supported in a storage portion provided in the support frame so as to be able to move in an up-down direction, and at least one of the first coupling portion and the second coupling portion is configured to release the coupling with the link portion.

4. The option device according to claim 1, wherein the first coupling portion includes a pin member configured to be, in an attachable/detachable manner, inserted through a through hole formed in the link portion and be engaged with an engagement hole formed in the push portion, and when the pin member is removed from the through hole, a coupling between the link portion and the push portion is released.

5. The option device according to claim 3, wherein the second coupling portion includes a pin member configured to be, in an attachable/detachable manner, inserted through a through hole formed in the link portion and be engaged with an engagement hole formed in the holder, and when the pin member is removed from the through hole, a coupling between the link portion and the second connector is released.

6. The option device according to claim 4, wherein the pin member includes at least one protruding piece protruding outward from a circumferential surface of the pin member, and the link portion includes at least one groove which is formed in a cut shape that extends from a peripheral edge of the through hole in an insertion direction of the pin member with respect to the through hole and in which the protruding piece enters in a state where the pin member is inserted through the through hole.

7. The option device according to claim 1, wherein the option device is a sheet feed device configured to store sheet members and feed the sheet members to the apparatus main body.

8. The option device according to claim 2, wherein the option device is a sheet feed device configured to store sheet members and feed the sheet members to the apparatus main body.

9. The option device according to claim 3, wherein the option device is a sheet feed device configured to store sheet members and feed the sheet members to the apparatus main body.

10. The option device according to claim 4, wherein the option device is a sheet feed device configured to store sheet members and feed the sheet members to the apparatus main body.

11. The option device according to claim 5, wherein the option device is a sheet feed device configured to store sheet members and feed the sheet members to the apparatus main body.

12. The option device according to claim 6, wherein the option device is a sheet feed device configured to store sheet members and feed the sheet members to the apparatus main body.

13. An image forming apparatus comprising:

the option device according to claim 1;

the apparatus main body; and the first connector which is disposed on the lower surface of the apparatus main body.

14. An image forming apparatus comprising:

the option device according to claim 2;

the apparatus main body; and the first connector which is disposed on the lower surface of the apparatus main body.

15. An image forming apparatus comprising:

the option device according to claim 3;

the apparatus main body; and the first connector which is disposed on the lower surface of the apparatus main body.

16. An image forming apparatus comprising:

the option device according to claim 4;

the apparatus main body; and the first connector which is disposed on the lower surface of the apparatus main body.

17. An image forming apparatus comprising:

the option device according to claim 5;

the apparatus main body; and the first connector which is disposed on the lower surface of the apparatus main body.

18. An image forming apparatus comprising:

the option device according to claim 6;

the apparatus main body; and the first connector which is disposed on the lower surface of the apparatus main body.

* * * * *